United States Patent [19]

Romanauskas

[11] Patent Number: 5,037,371

[45] Date of Patent: Aug. 6, 1991

[54] ROTOR RECOGNITION SYSTEM

[75] Inventor: William A. Romanauskas, Southbury, Conn.

[73] Assignee: E. I. Du Pont de Nemours and Company, Wilmington, Del.

[21] Appl. No.: 363,907

[22] PCT Filed: Dec. 9, 1987

[86] PCT No.: PCT/US87/03221

§ 371 Date: May 18, 1989

§ 102(e) Date: May 18, 1989

[87] PCT Pub. No.: WO88/04201

PCT Pub. Date: Jun. 16, 1988

[51] Int. Cl.[5] ..... B04B 15/00

[52] U.S. Cl. ..... 494/10

[58] Field of Search ..... 494/9, 10, 1, 7, 11, 494/85, 37, 84; 73/597

[56] References Cited

U.S. PATENT DOCUMENTS

| | | | |
|---|---|---|---|
| 3,746,247 | 7/1973 | Camilliere | 494/9 |
| 4,205,261 | 5/1980 | Franklin | 494/10 |
| 4,450,391 | 5/1984 | Hara | 494/9 |
| 4,551,715 | 11/1985 | Durbin | 494/10 |
| 4,601,696 | 7/1986 | Kamm | 494/10 |
| 4,700,117 | 10/1987 | Giebeler et al. | 318/327 |
| 4,827,197 | 5/1989 | Giebeler | 318/3 |

FOREIGN PATENT DOCUMENTS

| | | |
|---|---|---|
| 766651 | 10/1978 | U.S.S.R. . |
| 1156740 | 5/1985 | U.S.S.R. . |
| 2103407 | 1/1985 | United Kingdom . |

*Primary Examiner*—Robert W. Jenkins

[57] ABSTRACT

A transmitter and associated receiver interrogate the surface of a rotor at one or more radial positions from the center of rotation using emitted pulses of energy. Signature signals representative of the distance traveled by the pulses collectively form a signature signal pattern which is compared to a reference library of such signature signal patterns. Each pattern in the library represents one of a predetermined plurality of rotors. The comparison of the detected pattern with the patterns in the library representative of the identity of the interrogated rotor.

88 Claims, 11 Drawing Sheets

10
12
14
14
16
16A
16F
16S
18
20
21
21T
22
22C
23
23
24
24H
25R
25T
25R
25T
27
28
36
36
38
38
39
50'
52
52
54
54
B
C
K
R
S
VCL

VCL

Z
Y
X
X
Y
Z
D1
DX1=DX3=
DY1=DZ1
Q
DY3
DZ3
DX2=
DY2
D3
R3
DZ2
R1
D2
R2

34
50
46
COMPARATOR
MEMORY
48
$S_C$
$S_T$
$S_A$
39
REFERENCE
80
COMPARATOR
TIMER
TIME OUT PERIOD
38
R
42
41
40
27
E
T
36

| | RADIAL DISTANCE | | |
|---|---|---|---|
| ROTOR | X | Y | Z |
| R1 | 0 | 0 | 0 |
| R2 | 0 | 0 | 1 |
| R3 | 0 | 1 | 1 |

Fig. 4

Transducer
39
39L
GROUNDED CONDUCTIVE ENCLOSURE
66
5.1K
.1µf
70
72
+12VB
1K
68A
68B
ANA
Latch
Transmit
Receive
M
PRR
Trig. OUT
Trig. IN
Gnd.
+V
+12VB
DIRECTLY FROM MODULE TO GROUND PLANE
.47 µf
470 µf
150K
1K
+12 VA
10K
.1µf
2N2222
10K

ROTOR RECOGNITION SYSTEM

CROSS REFERENCE TO RELATED APPLICATION

This application is the national phase of International Application PCT/US87/03221 filed Dec. 9, 1987 and is also a continuation-in-part of U.S. application Ser. No. 06/940,143, filed Dec. 10, 1986, now abandoned.

BACKGROUND OF THE INVENTION

1. Field of the Invention

The present invention relates to a centrifuge instrument and in particular to a centrifuge instrument having a recognition arrangement for automatically identifying a particular rotor introduced into the centrifuge instrument.

2. Description of the Prior Art

A centrifuge instrument is a device adapted to expose a liquid sample carried in a rotating member called a rotor to a centrifugal force field. The centrifuge instrument includes a drive shaft or spindle adapted to receive any one of a predetermined plurality of individual rotors. It is important to correctly ascertain the identity of a particular rotor being used in the centrifuge instrument at any given time. Such information regarding rotor identity is important, among other things, for automatically controlling acceleration and deceleration times and for controlling the temperature of the rotor or other parameters of centrifuge operation related to the particular separation being effected in the rotor. Perhaps more importantly, however, rotor identification is vital to insure that the particular rotor being used is not rotated to a speed that presents the danger of rotor disintegration at a sufficiently high level as to breach the containment system of the centrifuge.

Presently, rotor identification may be performed manually by requiring the operator of the centrifuge to introduce information via the centrifuge instrument control panel regarding the identity of the particular rotor being utilized. This system is open to inadvertent error or deliberate misrepresentation by the operator and, thus, cannot be relied upon for providing rotor identification for any safety-related consideration.

Automatic systems for rotor identification are available. Exemplary of such systems are those shown in U.S Pat. No. 4,551,715 (Durbin) and U.S. Pat. No. 4,601,696 (Kamm). These systems utilize some form of coding elements usually disposed on the undersurface of the rotor. The coding elements are read by an appropriate optical or magnetic detector mounted in an operative location in the instrument. These systems share the disadvantage that the detector element, due to its location within the instrument, may be subject to corrosion which would vitiate its ability to accurately detect the coding elements. Moreover, retro-fitting carries with it a system would be inapplicable in ascertaining the identity of rotors not equipped with the appropriate coding elements. Thus, these identification systems would be unable to identify a significant population of rotors unless those rotors were retrofitted with the appropriate coding elements. Moreover. retro-fitting carries with it the risk of accidental or deliberate mismarking of the rotor and for this reason shares the same disadvantages as discussed above.

A rotor identification system, relying on the interruption of a beam of light from a source to a detector is disclosed in U.S. Pat. No. 4,450,391 (Hara).

In view of the foregoing it is believed advantageous to provide a rotor recognition system for automatically ascertaining the identity of each of a predetermined number of individual rotor elements introducible into the centrifuge instrument. Moreover, it is believed advantageous to provide such a recognition capability that is independent of the presence of coding elements on the rotors so that the entire established population of rotor elements may be identified.

SUMMARY OF THE INVENTION

In accordance with the present invention a system is provided for automatically recognizing which one of a predetermined plurality of centrifuge rotors is disposed within the centrifuge instrument. The rotor recognition system comprises a transmitter and an associated receiver mounted to the centrifuge instrument. The transmitter is operative to emit a pulse of interrogating energy. The transmitter and receiver are cooperative to generate a signature signal or a signature signal pattern based upon and representative of the distance traveled by the pulse of interrogating energy. In some instances this distance corresponds to the distance between the receiver and at least one but preferably a predetermined number of points on the surface of the rotor, respectively. The system also includes means responsive to the signature signal or the signature signal pattern for generating an indicator signal having information representative therein of the identity of the rotor in the centrifuge. The indicator signal generating means includes a library of signature signals or signal patterns each representative of a different rotor element validly able to be used with the centrifuge and means for comparing the detected signature signal or signal pattern with the library for generating the indicator signal on the basis of the results of the comparison.

In the preferred case the transmitter and associated receiver utilize sonic energy in the ultrasonic frequency range, although electromagnetic energy may also be used. The transmitter and the receiver are mounted in close proximity to each other on a portion of the centrifuge, typically the door of the centrifuge chamber, and as the same is drawn across or pivoted to cover the chamber in which the rotor is placed the signature signal or signature signal pattern of the rotor is effected.

BRIEF DESCRIPTION OF THE DRAWINGS

The invention will be more fully understood from the following detailed discription thereof taken in connection with the accompanying drawings which form a part of this application and in which:

FIG. 4 is an example of a truth table generated using a rotor recognition system in accordance with the present invention for identifying the rotors shown in FIG. 2;

DETAILED DESCRIPTION OF THE INVENTION

Figure 1:
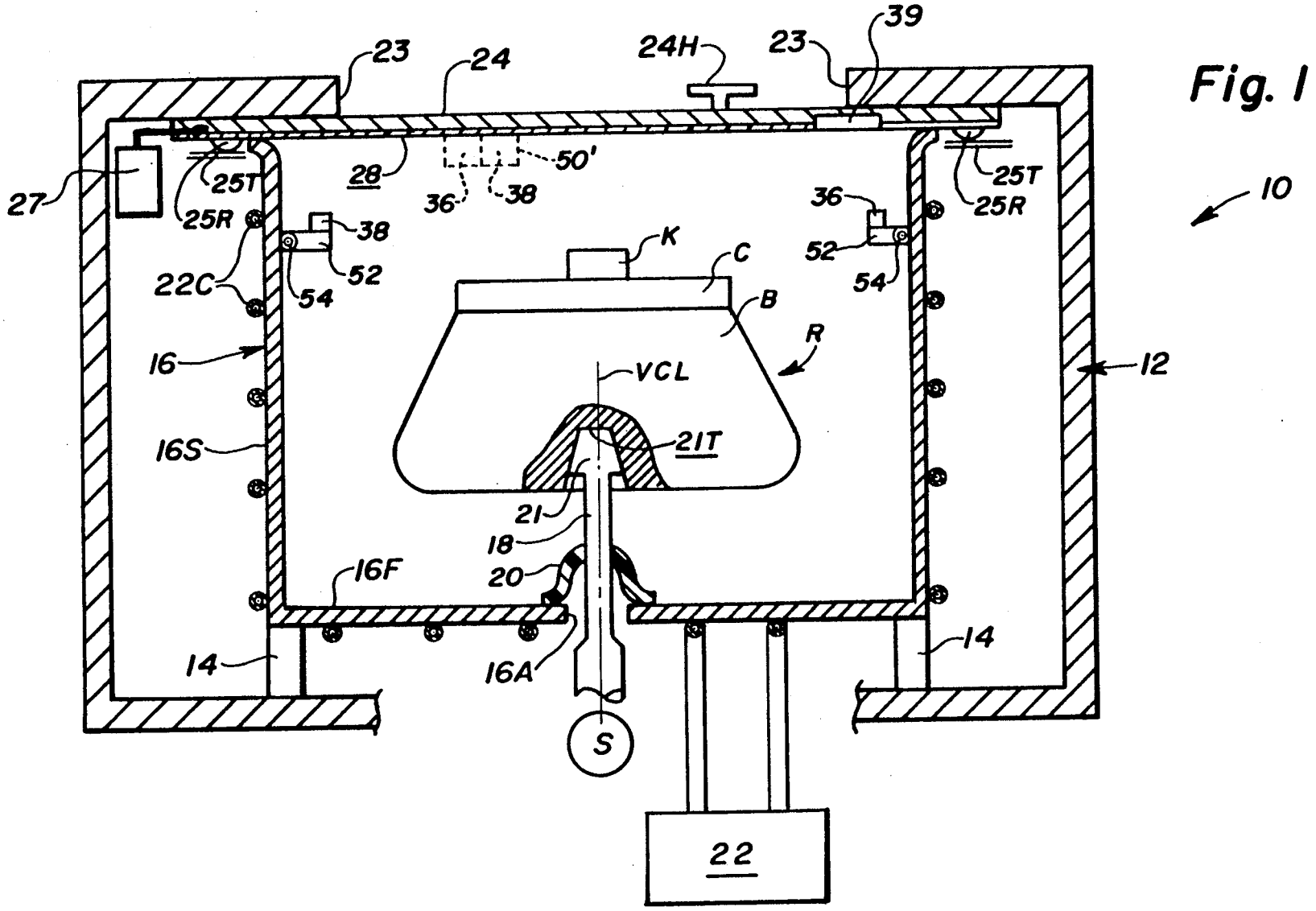
FIG. 1 is a highly stylized side elevational view in section of a typical centrifuge instrument with which the rotor recognition system in accordance with the present invention may find utility.

Throughout the following detailed description similar reference numerals refer to similar elements in all figures of the drawings.

With reference to FIG. 1 shown is a highly stylized pictorial representation in side elevation and in section of a centrifuge instrument generally indicated by reference character 10. The centrifuge 10 is shown as a generalized instrument to provide an understanding of the environment in which the present invention may be used. It should be understood that the representation of the centrifuge instrument 10 as shown in FIG. 1 is not to be construed in a limiting sense and that the invention herein disclosed may be used with any centrifuge instrument operative at any predetermined speed range. The centrifuge instrument 10 includes a housing 12. The housing 12 carries abutments 14 which support, on the interior of the housing 12, a rotor chamber or bowl 16. The bowl 16 includes a sidewall 16S and floor 16F thereon.

A drive spindle 18 extends centrally and axially through an aperture 16A in the floor 16F upwardly into the bowl 16. An elastomeric boot 20 closes the space between the aperture 16A in the floor 16F and the spindle 18. The upper end of the spindle 18 has a mounting element or spud 21 thereon. The spud 21 is a generally conical member externally configured to accept a rotor to be mounted thereon. The top surface 21T of the spud 21 is generally planar. The mounting element 21 is adapted to receive any one of a predetermined number of rotor elements generally indicated by reference character R and to interconnect the same to a source S of motive energy whereby the rotor R may be rotated about the vertical axis of rotation VCL. The rotor R has a body portion B which may receive a suitable cover C. The cover C may be suitably threadedly secured to the upper surface of the body B of the rotor R by any of a variety of expedients, such as a knob K, as known to those skilled in the art. The exterior surface of the bowl 16 is provided with refrigeration coils 22C connected to a refrigeration system generally indicated by reference character 22.

Access to the interior of the bowl 16 may be had through a central aperture 23 provided in the housing 12. The aperture 23 is closed by a door generally indicated by reference character 24 that is supported for movement on rollers 25R carried in suitable tracks 25T. The door 24 has a handle 24H thereon, although an automatic door operating mechanism may be provided, if desired. It should be understood that a hinged door may also be used, if desired, and remain within the contemplation of the present invention.

The door is similar in structure to that disclosed in U.S. Pat. No. 4,764,162 (Romanauskas) assigned to the assignee of the present invention (IP-642). As can best be seen in FIG. 5, in the preferred embodiment, the door 24 is fabricated of a steel plate 24P covered by an insulating layer 24I and a sheet metal or plastic skin 24S. The insulating layer 24I has a recess 24R and a communicating groove 24G provided therein for a purpose to be made clearer herein. The door plate 24P of the door 24 has an aperture 24A therein. Depending from the lower surface of the plate 24P are U-shaped channels, or guide rails, 24U (only one of which is seen in the elevational view of FIG. 5) sized to receive a removable seal assembly 26.

The removable seal assembly generally indicated by the reference character 26 includes a seal support plate 26S having a central opening 26C substantially conforming in shape to the aperture 23. The support plate 26S is provided with an annular seal member 26R mounted about the periphery of opening 26C therein. Mounted within the annular seal member 26R is an insulating insert 26I. The insulating insert 26I is circular in shape, and contains a planar upper surface 26U. The lower surface of the insulating insert 26I is provided with an array of concentric grooves 26G. As will be developed herein the grooves 26G serve as an energy dispersal mechanism. Of course, any suitable alternative geometry providing the same functionality, as will be explained more fully herein could also be used. An aperture 26A enables a vacuum to be drawn in the region 29 between the lower surface of the steel plate 24p on the door 24 and the planar upper surface 26U of the insulating insert 26I. The seal support plate 26S is slidingly engaged by the U-shaped channels 24U in a manner allowing the removal of the entire seal assembly 26 for servicing or cleaning. Locking means, such as shoulder bolts (not shown). is used to fasten the seal assembly 26 in its proper position in the U-shaped channels 24U.

Figure 8:
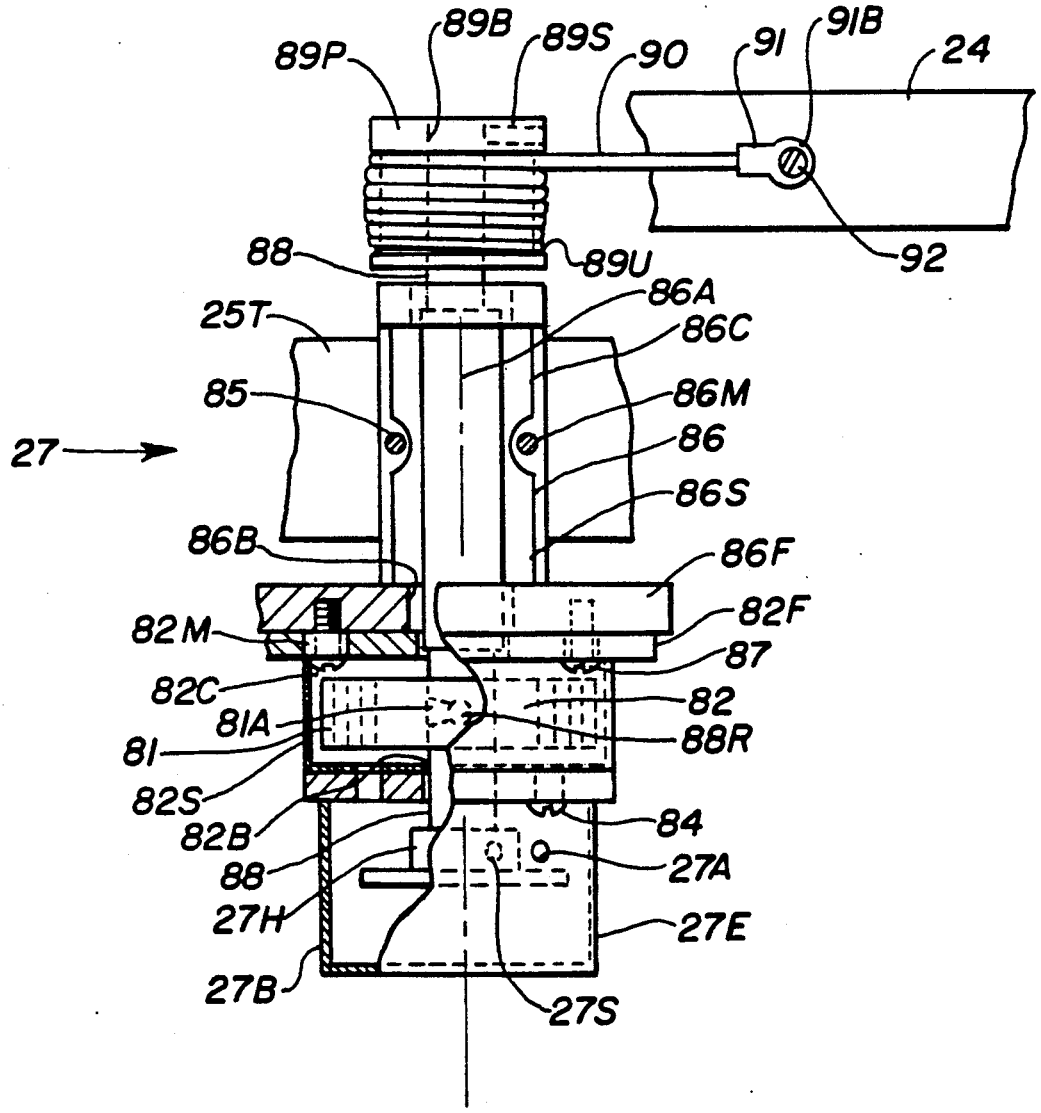
FIG. 8 is a side elevational view of an encoder assemblY used to indicate the position of the transducer shown in FIG. 5 relative to the axis of rotation of the rotor as the door of the instrument is closed.

An encoder assembly, generally indicated by reference character 27, is operatively associated with the door 24 for the purpose of providing information as to the position of a point on the door 24, or any device mounted thereon, with respect to a predetermined reference datum, e.g.. the axis of rotation of the rotor VCL. The details of the encoder assembly 27 are described in detail in connection with FIG. 8. to which reference is now invited.

The encoder assembly 27 includes an optical encoder 27E such as that manufactured by Hewlett Packard as model number HEDS-5500-C06. The optical encoder 27E is attached to one end of a central shaft 88 by means of a hex headed set screw 27S that is within a code wheel hub 27H that forms part of the optical encoder 27E. Access to the set screw 27S is afforded through an orifice 27A in the body 27B of the optical encoder 27E. Affixed to the opposite end of the central shaft 88, as by set screws 89S is a pulley 89P. The pulley 89P is a substantially cylindrical member with a central bore 89B sized to receive the central shaft 88. Attached to the pulley 89P via a set screw (not visible) is one end of a cable 90 having a ring terminal 91 located at the free end thereof. The ring terminal 91 has a bore 91B through which passes a screw 92. The screw 92 threadedly secures engaging the ring terminal 91 to the door 24. An undercut 89U on the periphery of the pulley 89P is sized to contain the full length of the cable 90 when it is fully retracted and wrapped about the pulley 89P.

The optical encoder 27E is attached via three self-tapping screws 84 to a spring cup 82. The spring cup 82 has a substantially cylindrical body 82S with a flange 82F at the end thereof opposite the optical encoder 27E. The spring cup is made from a glass-filled nylon material. The spring cup 82 has a bore 82B through which the central shaft 88 freely passes. Additionally, a cavity 82C is contained within the spring cup 82 in communication with the bore 82B. This cavity 82C is sized to accept a constant force spring 81 such as that sold by John Evans Sons, Inc. of Lansdale, Pennsylvania. The constant force spring is configured from a flat piece of steel formed into a coil. With one end of the coil fixed and the other end displaced, the coil wraps about its axis thus providing a force tending to restore the spring to its initial position. In this embodiment the outside end of the spring 81 is fixedly held by a rivet (not visible) to the peripheral wall of spring cup 82 defining the cavity 82C. The inner end of the spring 81 (located at the center of the coil) contains an aperture 81A which is sized to engage a raised portion 88R on the central shaft 88. The aperture 81A is shaped such that it engages the raised portion 88R on the central shaft 88 only when the shaft is rotated in a specific direction. Should the direction of rotation be reversed, the raised portion 88R is not capable of engaging the aperture 81A in the end of the constant force spring 81.

The spring cup 82 is attached to a main mounting member 86 using three screws 87 extending through corresponding bores 82M in the flange portion 82F of the spring cup 82. The main mounting member 86 has a substantially cylindrical body 86S with a flange 86F on one end onto which the spring cup 82 is mounted. A bore 86B located on the central axis 86A of this mounting member is sized to clear the central shaft 88 which passes therethrough. A cavity 86C is provided in the side of the cylindrical portion 86S of the mount 86. The cavity 86C is in communication with two bores 86M. Both bores 86M are perpendicular to the axis 86A of the cylindrical body 86S.

The encoder assembly 27 may be mounted within the instrument in any convenient manner. For example, the bores 86M are sized to accept screws 85 which mount the encoder assembly 27 to stationary track 25T. With the mounting member 86 so attached to the track 25T and the ring terminal 91 attached to the door 24, the encoder assembly 27 is operable to determine the magnitude of any displacement of the door 24.

When the door 24 is open the cable 90 is in its retracted position wrapped about the pulley 89P. In the retracted position the constant force spring 81 provides a force which keeps the cable 90 taut. As the door 24 is closed the cable 90 is drawn from the pulley 89P rotating the central shaft 88. The central shaft 88 in turn rotate code wheel hub 27H generating encoding counts. The optical encoder 27E selected has in the preferred case one hundred counts per revolution. Through the mounting means described this equates to a linear displacement of the door 24 of 0.020 inches (0.0508 cm.) per generated count.

For the various reasons, paramount among them the overall safety of centrifuge operation, it is advantageous to accurately ascertain in an automatic fashion the identity of the particular rotor R mounted atop the drive spindle 18. The present invention provides an arrangement for accurately recognizing a particular rotor R as the same is mounted within the bowl 16.

Figure 2:
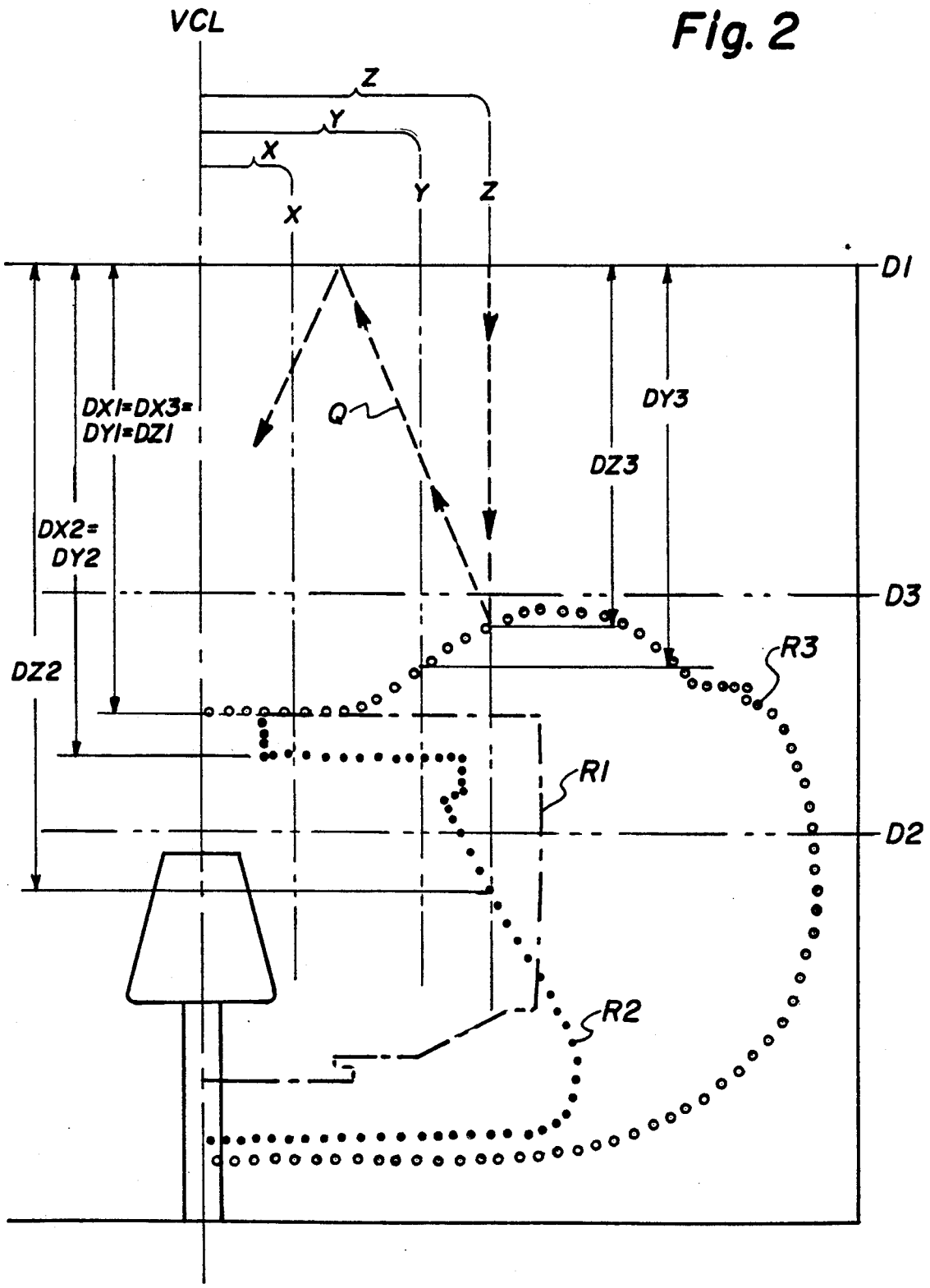
FIG. 2 is a diagrammatic view in side elevation of the profiles of three different rotors and is used to discuss the generation of various types of signature signals in accordance with the present invention.

With reference to FIG. 2 shown are enlarged profiles of three different centrifuge rotors $R_1$, $R_2$, and $R_3$ whose identity may be ascertained automatically in accordance with the present invention. The profiles are taken in side elevation. The profile of the rotor $R_1$ is shown in dot dash lines, the profile of the rotor $R_2$ is shown in dotted lines, while the profile of the rotor $R_3$ is shown in open circle. The rotors $R_1$, $R_2$ and $R_3$ respectively correspond in general with the rotors manufactured and sold by E. I. du pont de Nemours and Company, Inc. as TZ-28 zonal rotor, SS-34 fixed angle rotor and HS4 swinging bucket rotor, respectively. The rotors are depicted with their associated covers in place.

As is readily apparent from examination of FIG. 2 the rotors $R_1$, $R_2$, and $R_3$ each have certain similarities but exhibit rather prominent differences in their profiles. For example at a first radial position lying a predetermined radial distance X measured from the vertical centerline VCL the first and third rotors $R_1$ and $R_3$ have planar surfaces that lie substantially the same vertical distance $D_{X1}$, $D_{X3}$ below and parallel to a first reference datum plane $D_1$. The rotor $R_2$ at the same radial distance X has a planar surface that lies a greater vertical distance $D_{X2}$ below the same datum plane $D_1$. Likewise at a second radial position lying a radial distance Y from the centerline VCL the surface of each of the rotors $R_1$, $R_2$, $R_3$ lies at different vertical distances $D_{Y1}$, $D_{Y2}$, and $D_{Y3}$, respectively. At this radial distance Y, as seen in FIG. 2, the surface of the rotors $R_1$ and $R_2$ are planar and parallel to the datum plane $D_1$ while the rotor $R_3$ exhibits a surface that is curved with its slope defining a predetermined angle with respect to the datum plane $D_1$. At a third radial position lying a radial distance Z from the centerline VCL the surface of the rotor $R_1$ is planar and parallel to the datum plane $D_1$, the rotor $R_2$ exhibits a planar surface that is inclined at a predetermined angle with respect to the datum plane $D_1$, and the rotor $R_3$ exhibits a curved surface whose slope also defines a predetermined angle with respect to the datum plane $D_1$.

From the foregoing it may be appreciated that each of a predetermined number of rotors $R_1$ through $R_N$ may be shown to exhibit a predetermined profile corresponding to structural features of the rotors at various predetermined radial positions from the axis of rotation VCL. The recognition system of the present invention capitalizes on these differences in rotor profile to automatically recognize a particular rotor mounted in a centrifuge instrument at a given time.

Figure 3:
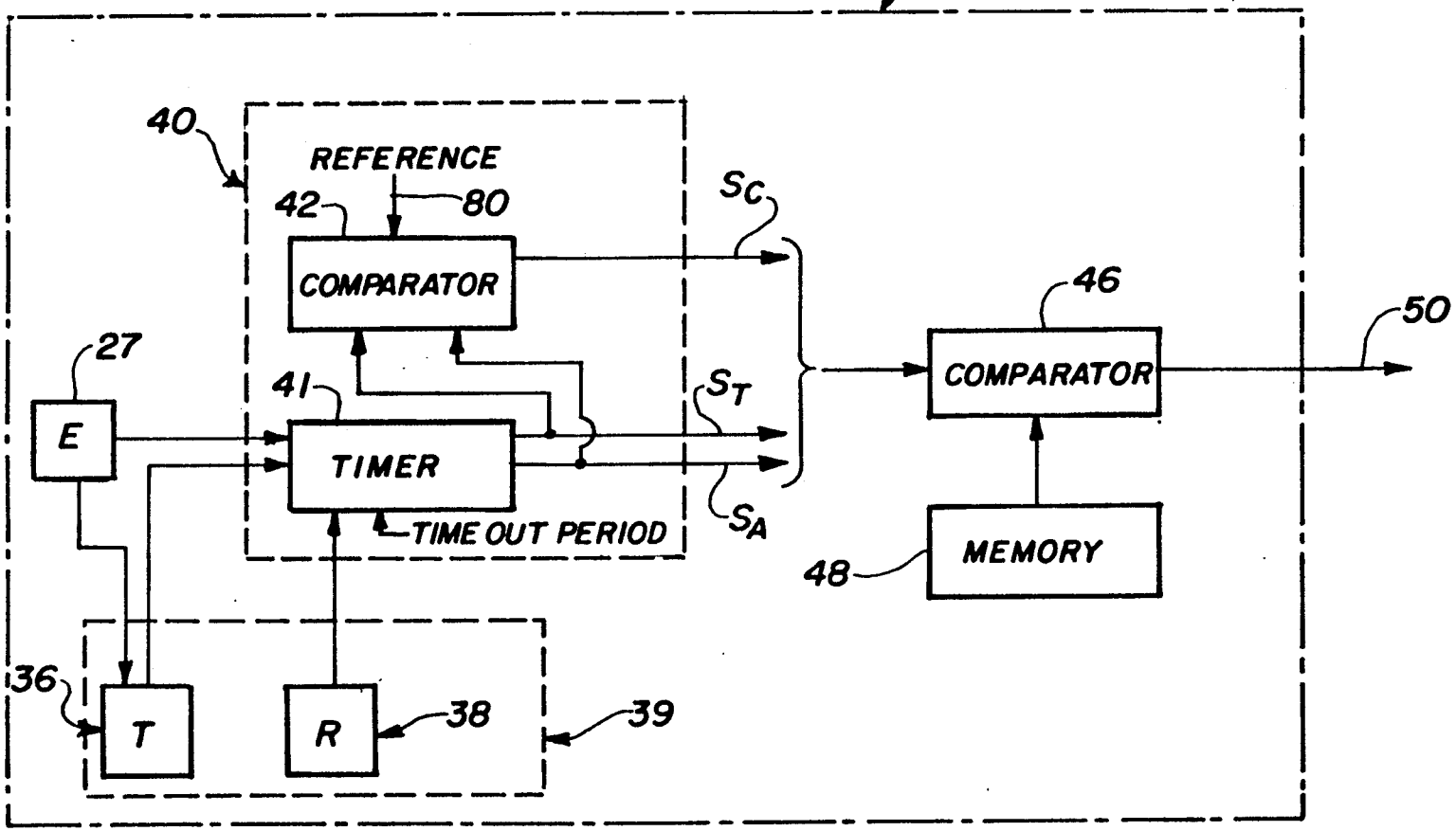
FIG. 3 is a block diagram of the functional elements of the rotor recognition system in accordance with the present invention.

As shown in block diagram form in FIG. 3 the rotor recognition system 34 in accordance with the present invention includes an energy source, or transmitter, 36 and an associated receiver 38. In the preferred embodiment, as will be discussed subsequently, a single device, such as a crystal 39, hereafter referred to as "the transducer," serves alternately to function as the transmitter 36 and as the receiver 38. However, since this integrated configuration need not be utilized the drawings will, as appropriate, contain functional blocks 36, 38. The transmitter 36 and the receiver 38, however they are configured, are each mounted conveniently at any predetermined location on the interior of the instrument 10. The structural details of the preferred mounting arrangement will be discussed in more detail herein in connection with FIG. 5.

The transmitter 36 and the receiver 38 are operative to interrogate the particular rotor R mounted in the instrument 10 at at least one but preferably at a predetermined plurality of radial positions measured from the axis VCL of the instrument 10. The interrogation takes the form of of the impingement on the surface of the rotor of a pulse of interrogating energy emitted from the transmitter 36.

The transmitter 36 and the receiver 38 are cooperably associated to generate a signature signal representative, in general, of the distance traveled by the pulse of interrogating energy. Generally the pulse of interrogating energy is directed toward and impinges on the surface of the rotor at each radial position that the rotor is interrogated. However, as will be explained, the pulse of interrogating energy may also be directed toward and impinge upon predetermined target surfaces within the chamber. In some instances the signature signal may be a measure of the actual distance traveled by the pulse of interrogating energy and as such is translatable into a representation of the actual distance between the receiver 38 and the surface of the rotor at each radial position at which the rotor is interrogated. In other instances the signature signal is generated as a result of a comparison and is representative of the fact that the pulse of interrogating energy has traveled a distance greater than or less than a predetermined reference distance. In these other instances, depending upon the magnitude of the reference distance chosen, an inference as to the shape of the rotor at the point of impingement may be made.

The signature signals from each interrogated point on the rotor cooperate to collectively define a signature signal pattern. As will be developed, either a selected signature signal or a signature signal pattern may be used in accurately recognizing a given rotor.

To produce the signature signal, means generally indicated by reference character 40 is connected to both the transmitter 36 and to the receiver 38. It should be readily appreciated that the distance traveled by the pulse and the elapsed time of travel are related by the constant, viz.. the speed of sound in the environment of the chamber. Therefore, although the discussion may be phrased in terms of distance traveled by the pulse, the measurement of this distance is effected by measuring elapsed time of travel. The means 40 includes a timer 41 that is initiated simultaneously with the emission of the pulse of interrogating energy from the transmitter 36. In the preferred case the positions within the chamber at which the interrogation pulse is emitted is controlled using the positional outputs provided by the encoder assembly 27. Thus, as shown diagrammatically in FIG. 3, the encoder assembly 27 is operatively connected to the transmitter 36 and the timer 41. The timer 41 measures the elapsed time from the emission of the pulse until the reflection thereof is detected by the receiver 38. Such a signature signal (e.g.. the signature signal $S_A$) is translatable into a representation of the actual distance between the receiver 38 and the interrogated surface of the rotor R. If the reflected pulse is not detected by the receiver 38 within a predetermined time-out period of time as measured by the timer 41, a signature signal $S_T$ is produced indicative of this fact.

The means 40 may also include a comparator 42 which is operative to compare the signature signals of the type $S_A$ and $S_T$ as measured by the timer 41 with a reference time representative of a predetermined reference distance on the line 80. The result of such a comparison is a signature signal of the type indicated by the reference character $S_C$. It may be appreciated from the foregoing that a time-out signal $S_T$ from the timer 41, in effect, represents a comparison of an unknown distance of travel by the pulse with a reference distance accomplished without the use of a comparator. All of the foregoing discussion is meant to provide an understanding of some of the various ways in which a signature signal may be produced. All such ways are contemplated by the present invention.

The recognition system 34 further includes a comparator 46 operatively associated with the means 40 and arranged to compare the signature signal or signature signal pattern of a given rotor R with a predetermined library of signature signals or signature signal patterns. The library is stored in a suitable memory 48. Based upon the comparison between the detected signature signal or signature signal pattern and the reference library an indicator signal is output on a line 50 from the comparator 46. The indicator signal contains information therein representative of the identity of the particular rotor disposed in the centrifuge.

The generation of the various types of signature signals may be understood with reference again to FIG. 2. The single crystal transducer 39 implementing both the transmit and the receive functions is to be understood to be disposed on the datum plane $D_1$ such that the path of travel of a pulse of interrogating energy emitted from the transducer is perpendicular to the datum plane $D_1$. For example, if the rotor $R_1$ is disposed in the chamber interrogation of the rotor $R_1$ at the radial distance X, the radial distance Y and the radial distance Z, positions at which the rotor $R_1$ exhibits a planar surface that is parallel to the datum plane $D_1$, then the pulse of interrogating energy will likely impinge on the planar surface of the rotor and reflect back to the transducer. The means 40 thus generates a signature signal of the type $S_A$. The signature signal so produced at each radial position is representative of the time required for energy emitted from the source 36 to reflect from the surface of the rotor $R_1$ at those respective points and return to the receiver 38. This information provides a representation of the actual distance that the surface of the rotor $R_1$ at the radial distances X, Y, and Z lie from the transducer 39. Since the transducer 39 is construed to lie on the datum plane $D_1$ the signature signals of the type $S_A$ output from the means 40 would respectively represent the distances $D_{X1}$, $D_{Y1}$, and $D_{Z1}$.

The same type of signature signal $S_A$ may be produced by the means 40 from interrogation of the rotor $R_2$ at the radial distances X and Y from the vertical centerline VCL. The signature signals of the type $S_A$ so produced would be translatable into a representation of the actual distances $D_{X2}$ and $D_{Y2}$. Similarly, interrogation of the rotor $R_3$ at the radial distance X may also result in a signature signal of the type $S_A$ that is translatable into a representation of the actual distance $D_{X3}$. It should be appreciated that signature signals of the type $S_T$ may also be produced from interrogation of the planar parallel surfaces of the rotors $R_1$, $R_2$, $R_3$ by selection of an appropriate predetermined time-out period.

It may also be understood that interrogation of the rotor $R_1$ at the radial distance X, Y and Z could be used to produce signature signals of the type $S_C$ using the means 40. For example, if a second reference datum plane $D_2$, parallel to the datum plane $D_1$ were defined, a comparison of the elapsed time between the emission of the pulse of interrogating energy and the detection of its reflection with a reference time representative of the time a pulse should require to travel the reference distance from the datum plane $D_1$ to the datum plane $D_2$ and back could produce a signature signal of the type $S_C$. Such a signature signal would provide information as to the position of the interrogated surfaces of the rotor with respect to the datum plane $D_2$. In the example chosen since the datum plane $D_2$ is below the interrogated surfaces of the rotor the signature signals $S_C$ so produced would indicate that the interrogated surfaces are above the datum plane $D_2$. That is to say the pulse of interrogating energy traveled a distance less than the predetermined reference distance to and from the datum plane $D_2$. If the datum plane $D_3$ were used, signature signals of the type $S_C$ would indicate that the pulse traveled a distance greater than the reference distance, in this instance the reference distance being the distance forum the datum plane $D_1$ to the datum plane $D_3$ and back. The signature signals $S_C$ would thus be indicative of the fact that the interrogated surfaces are below the datum plane $D_3$. Similar signature signals of the type $S_C$ may be generated for the planar, parallel surfaces of the rotor $R_2$ or the rotor $R_3$.

Signature signals of the type $S_A$ cannot be formed when the rotor is interrogated at a point of impingement that is either a curved surface or an inclined planar surface because the likelihood is that a reflected pulse would not return to the transducer and thus a representation of the actual distance of travel cannot be made. Therefore, signature signals of the type $S_T$ may be especially useful where the rotor has curved or planar inclined surfaces thereon. In this event the reference distance may be conveniently defined as the distance from the datum plane $D_1$ to a location on the floor 16F of the chamber 16 and back. A location on the floor 16F is chosen because the floor is the planar parallel surface that lies farthest from the datum plane $D_1$ in the closed chamber 16.

Assume, for example, that the rotor $R_3$ is mounted and interrogated at the radial distance Z and that the time-out period of the timer 41 or the reference time for the comparator 42 represents the reference distance from the datum plane $D_1$ to the floor 16F and back. Since the surface of the rotor $R_3$ at the radial distance Z is curved the pulse of interrogating energy will impinge on the curved surface and be reflected therefrom in the direction shown by the dashed line Q. The pulse will likely continue to be reflected from various surfaces within the chamber. Accordingly, the probability is very high that the reflected pulse would travel a distance within the chamber greater than the predetermined reference distance. If the pulse does not return to the receiver prior to the expiration of the time-out time the signature signal $S_T$ output from the timer 41 or a signature signal $S_C$ produced as a result of the comparison of the signal $S_T$ with the reference time in the comparator 42 will be indicative of the fact that the pulse has traveled a distance greater than this reference distance. From this fact an inference as to the shape of the rotor at the point of impingement may be drawn. Similarly a signature signal of the type $S_T$ or $S_C$ would be produced upon interrogation of a rotor $R_3$ at the radial distance Y and a rotor such as the rotor $R_2$ at the radial distance Z. A similar reference as to the shape of the rotor (i.e., either curved or inclined planar) may likewise be drawn.

The various types of signature signals or signature signal patterns produced in accordance with the present invention are then compared by the comparator 46 with the library of signature signals or signature signal patterns stored in the memory 48. Several examples may suffice to explain the various possible modes of operation of these elements of the means 34.

In one of the simpler cases the signature signal produced as the result of an interrogation of a rotor in the chamber at one point can be used to generate an indicator signal of the rotor's identity. For instance, in FIG. 2 at the radial distance X from the axis of rotation VCL, for a transducer on the datum plane $D_1$, the distance $D_{X1}$ that a point on the surface of the rotor $R_1$ lies from the transducer is distinctly different from the distance $D_{X2}$ that a point on the surface of the rotor $R_2$ lies from the transducer. Therefore the identity of these two rotors can be readily distinguished on the basis of a signature signal of the type $S_A$ produced from an interrogation at only this one radial distance. Thus, a comparison of the signature signals $S_A$ representative of the actual distance between the transducer and the point of interrogation of an unknown rotor with a library of actual distances for each rotor in a predetermined population of rotors validly able to be run on the instrument will produce an indicator signal representative of the identity of the rotor in the chamber.

A determination of rotor identity based on a signature signal derived from only one point of interrogation is subject to limitations. To be distinguishable each rotor in the population must have a unique signature signal for an interrogation taken at the given radial distance. In practice this may not be possible.

It is therefore necessary to utilize a signature signal pattern to identify one rotor as against another. As an example, interrogation taken at the radial distance X of rotors $R_1$ and $R_3$ would produce the same signature signal of the type $S_A$ since the distance $D_{X1}$ is equal to the distance $D_{X3}$. However, a second interrogation at the radial distance Y would result in a signature signal pattern for the rotors sufficient to differentiate between these two rotors. Interrogation of the rotor $R_1$ at the radial distance Y leads to the signature signal of the type $S_A$ representative of the actual distance $D_{Y1}$ while interrogation of the rotor $R_3$ would produce a signature signal of the type $S_T$, both in the manner discussed above.

As the population of rotors increases the number of points which must be interrogated before a unique signature signal pattern is generated for each rotor will likely increase.

Using signature signals of the type $S_C$ or $S_T$ it is possible that rotors can be identified without knowledge of the actual distance that a point on the surface of the rotor lies from the datum on which the transducer is disposed. As discussed for example, it is possible to create a pattern of signature signals of the type $S_C$ or $S_T$ based upon whether the distance traveled by a pulse of interrogating energy is greater than or less than some predetermined reference distance. Again for purposes of illustration referring to FIG. 2 with the reference datum plane being shown by the reference character $D_2$ for the interrogations of the rotors $R_1$, $R_2$, and $R_3$ at the radial distance X, Y, and Z a truth table as shown in FIG. 4 may be constructed. In the truth table a "0" symbol denotes that the distance traveled by the pulse of energy is less than the reference distance from the transducer to the datum plane $D_2$ and back. A "1" denotes that the distance traveled by the pulse of interrogating energy is greater than the plane $D_2$ and back.

As shown in the truth table in FIG. 4 interrogation of the rotor $R_1$ at the radial distances X, Y, and Z produces a "0" character. As seen in FIG. 2, since the surface of the rotor $R_1$ at the radial distances X, Y, and Z are all planar, parallel and all lie closer to the transducer than does datum plane $D_2$ the signature signal produced at each point indicates that the pulse has traveled less than the reference distance to and from the datum plane $D_2$. Similarly for the rotor $R_2$ interrogation at the radial distance X, Y, and Z produces a "0", "0", "1", respectively. The "1" entry produced at the radial distance Z may be understood when one considers that the surface of the rotor $R_2$ at point Z is inclined with respect to the datum plane $D_1$ and thus, as developed earlier, an inclined surface causes the pulse to be reflected within the chamber in a manner such that its path is in excess of the reference distance to and from datum plane $D_2$. The entries to the truth table for the rotor $R_3$ are similarly derived.

It is immediately recognized that the signature signal pattern set forth in the truth table for each of the rotors is unique. Comparison of the pattern resulting from the interrogation of a rotor to the library of possible patterns stored in a memory would lead to the generation of the indicator signal representative of the identity of the rotor.

This indicator signal may be used in any desired manner. For example, the indicator signal may be used to limit rotor speed, to adjust other rotor dependent run parameters, or to render the centrifuge inoperable under certain conditions.

Figure 5:
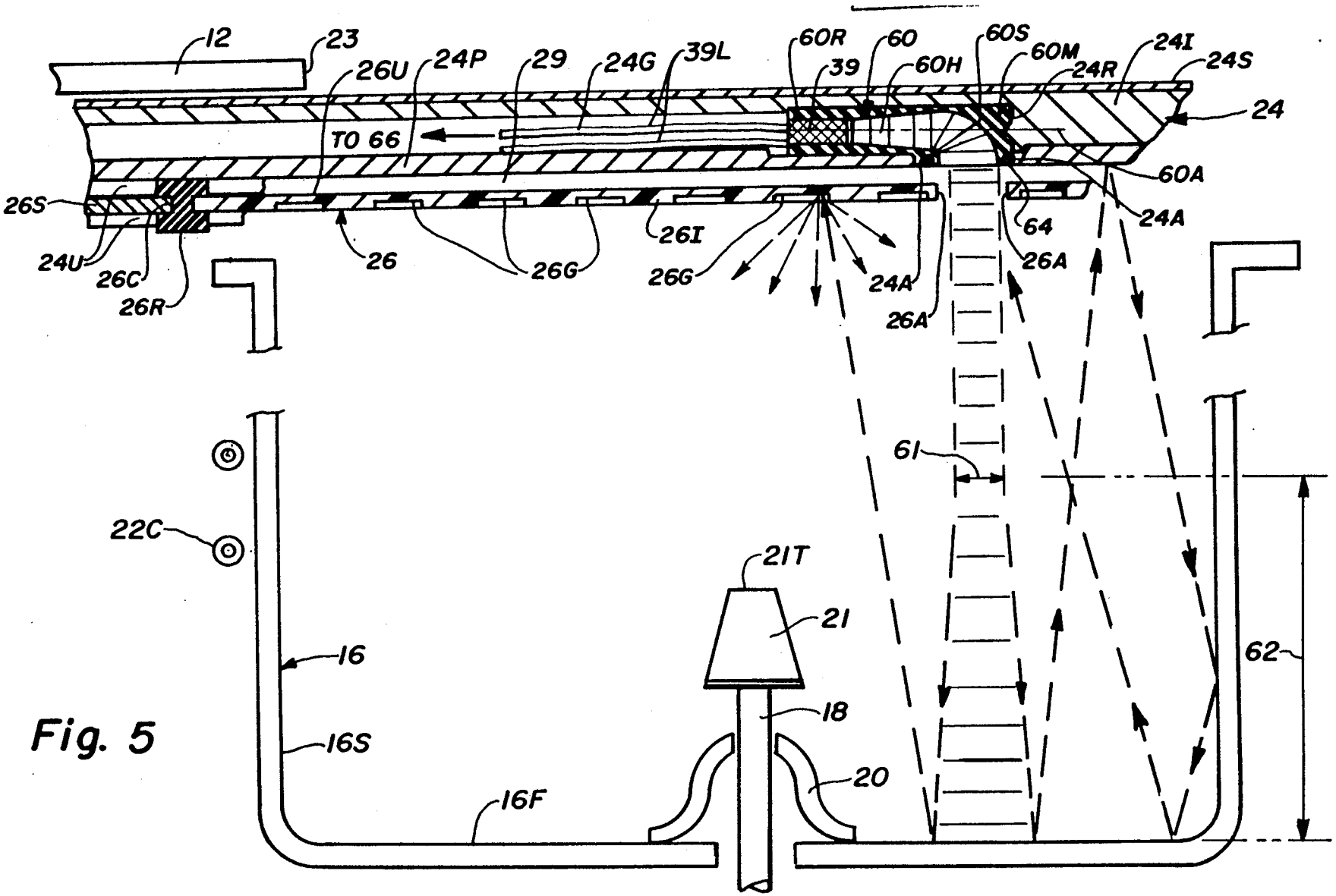
FIG. 5 is a side elevational view in section illustrating the mounting arrangement for a transducer in accordance with the preferred embodiment of the present invention.

Suitable for use as the transmitter and the receiver is a single crystal narrow beam ultrasonic transducer 39 as manufactured by Massa Products Corporation, and sold as model number E-188/215. As will be developed herein the single crystal is configured to act as both the transmitter and the receiver. As seen in FIG. 5 the transducer 39 is mounted in a modular plastic housing generally indicated by reference character 60 that is itself received into the recess 24R provided in the insulation layer 24I of the door 24. The housing 60 is hollow with a first end and a second end thereon. The transducer 39 is disposed in a recess 60R adjacent the second end of the housing 6 that is sized to closely receive the same. The interior of the housing 60 forwardly of the transducer 39 defines a conical cavity 60H that communicates with the second, open, end of the housing 60. The walls of the housing 30 defining the conical cavity 60H incline at a predetermined angle. e.g., ten degrees, with respect to the axis 60A of the housing 60 to form an ultrasonic horn which columnates or limits the spread of the pulse of interrogating energy emitted from the transducer.

Disposed adjacent to the second end of the housing 60 is a reflecting member 60M having a shaped surface 60S thereon. The surface 60S reflects and focuses the interrogating pulse in a direction perpendicular to the axis 60A of the housing 60 and directs the same through the registered apertures 24A, 26A in the door plate 24p and in the removable seal plate 26I, respectively, and into the chamber 16 of the instrument. The housing 60 is fabricated of plastic such as an acetal resin manufactured and sold by E. I. du Pont de Nemours and Company, Inc. and sold as "Delrin."

This configuration is believed advantageous in that it serves to increase the effective length of travel of the interrogating pulse without a concomitant increase in the height of the chamber 16. Preferably the shaped surface 60S is ellipsoidal. Also, in the preferred case the confining action of the horn 60H and the shaped surface 60S serves to decrease the effective width 61 of the beam at a predetermined height 62 in the chamber at which the interrogation of the rotors most often occurs. A narrow beam width is preferred for enhanced sensitivity.

An 0-ring seal 64 is captured in a groove provided in a cylindrical extension of the mirror member 60M and seats against the periphery of the aperture 24A in the door plate 24P to vacuum seal the chamber 16. The leads 39L from the transducer 39 lie in the groove 24G in the insulation layer 24I of the door 24 and extend to the rear of the instrument.

Figure 6:
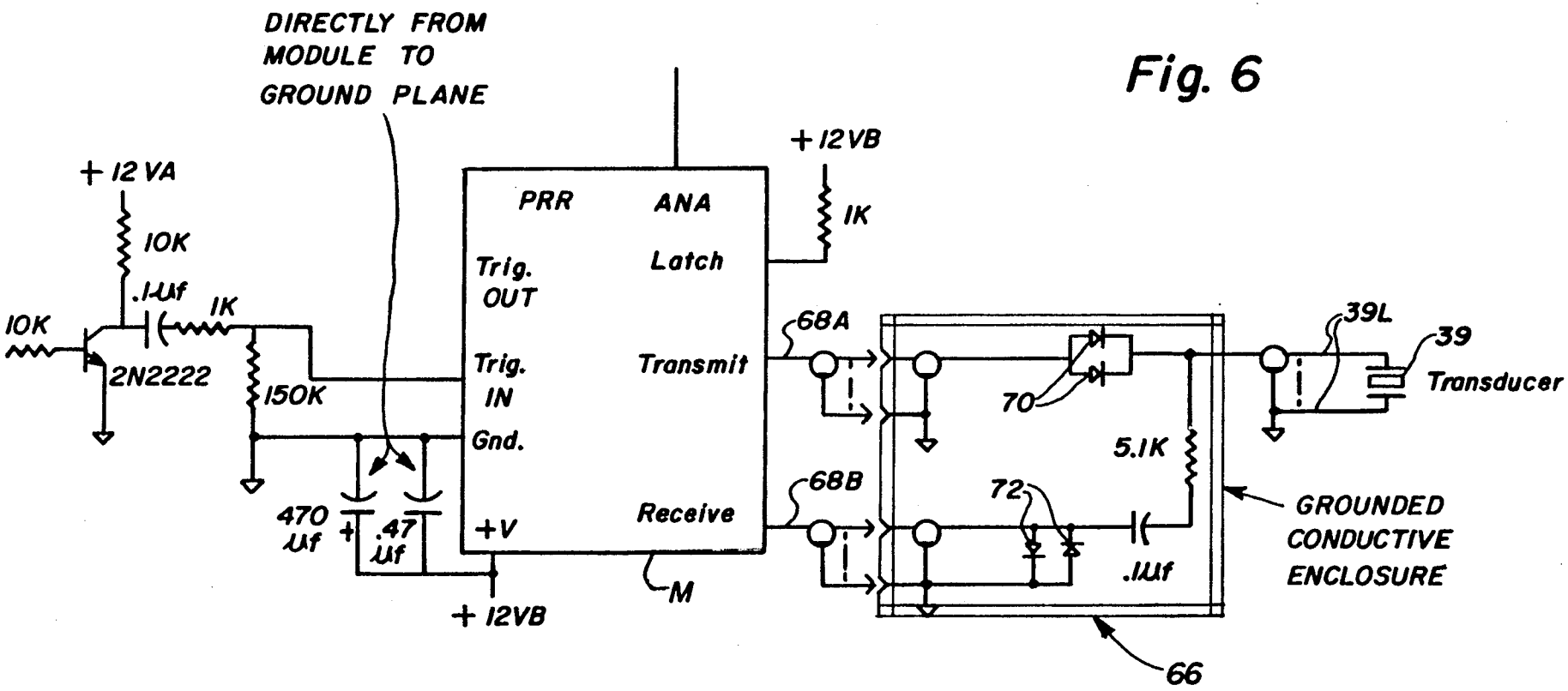
FIG. 6 is a schematic diagram of a drive circuit for the transducer mounted in FIG. 5 in accordance with the preferred embodiment of the present invention.

At the rear of the instrument the leads 39L from the transducer 39 are connected to a control network 66 schematically shown in FIG. 6, the transducer control module M is provided by the manufacturer with the transducer 39. The "transmit" and the "receive" terminals from the module M are connected over coaxial cables 68A, 68B, respectively, to the control network 66. The network 66 contains diode arrays 70, 72. The diodes in the array 70 are forward biased by high signal swings during transmit mode. The diodes in the array 72 are connected to ground potential and protect the receive in terminal from strong transmit signal voltages. During the receive mode the low voltage signals are unable to forward bias any of the diodes in either array, thereby steering the receiving energy from the transducer to the receive in terminal. The transmit frequency for the crystal is selected at 230 kHz while the receive frequency is 220 kHz. The duration and amplitude of any ultrasonic pulses emitted by the transducer 39 are selected such that transmitted pulses decay in an exponential fashion within a predetermined time period so as not to interfere with or contribute to any returning reflected ultrasonic pulses.

In accordance with the preferred embodiment of the present invention the transducer 39 adapted to respectively emit and detect sonic energy in the ultrasonic frequency range. However, a suitable transmitter and receiver of electromagnetic energy at any predetermined frequency, such as infrared light, may be used and remain within the contemplation of the present invention.

Since sound is influenced by the temperature of the medium through which it is propagates some manner of temperature compensation may need to be performed so that meaningful comparisons between the measured and the stored signals may be made. To this end the means 34 may be modified, as shown in FIGS. 7A and 7B, to further include a temperature compensation means 74 for compensating for deviations which may be caused by the ambient environment in the chamber 16.

Figure 7A:
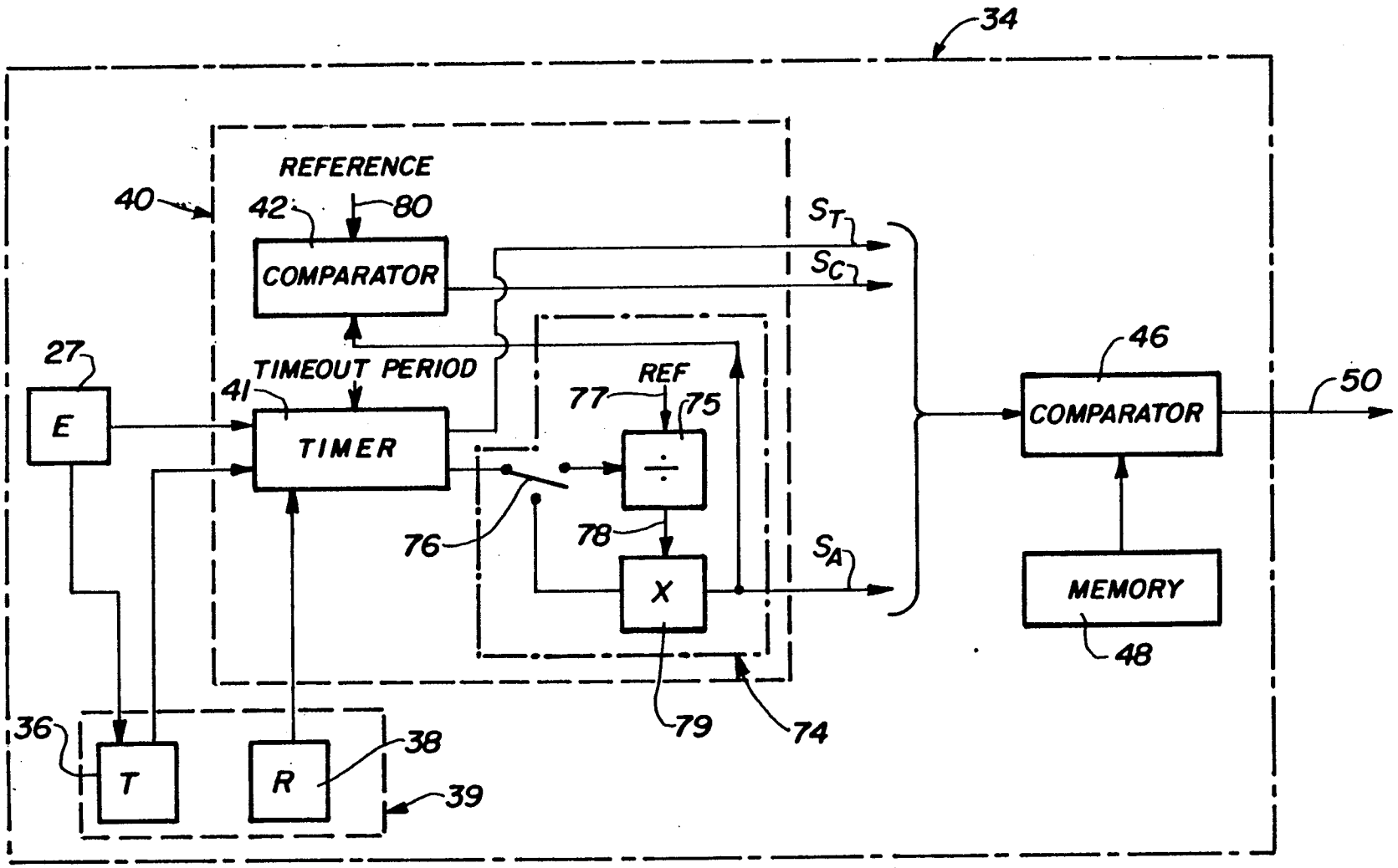
FIGS. 7A and 7B are block diagrams similar to FIG. 3 of the functional elements of a rotor recognition system including temperature compensation means in accordance with the present invention.
Figure 7B:
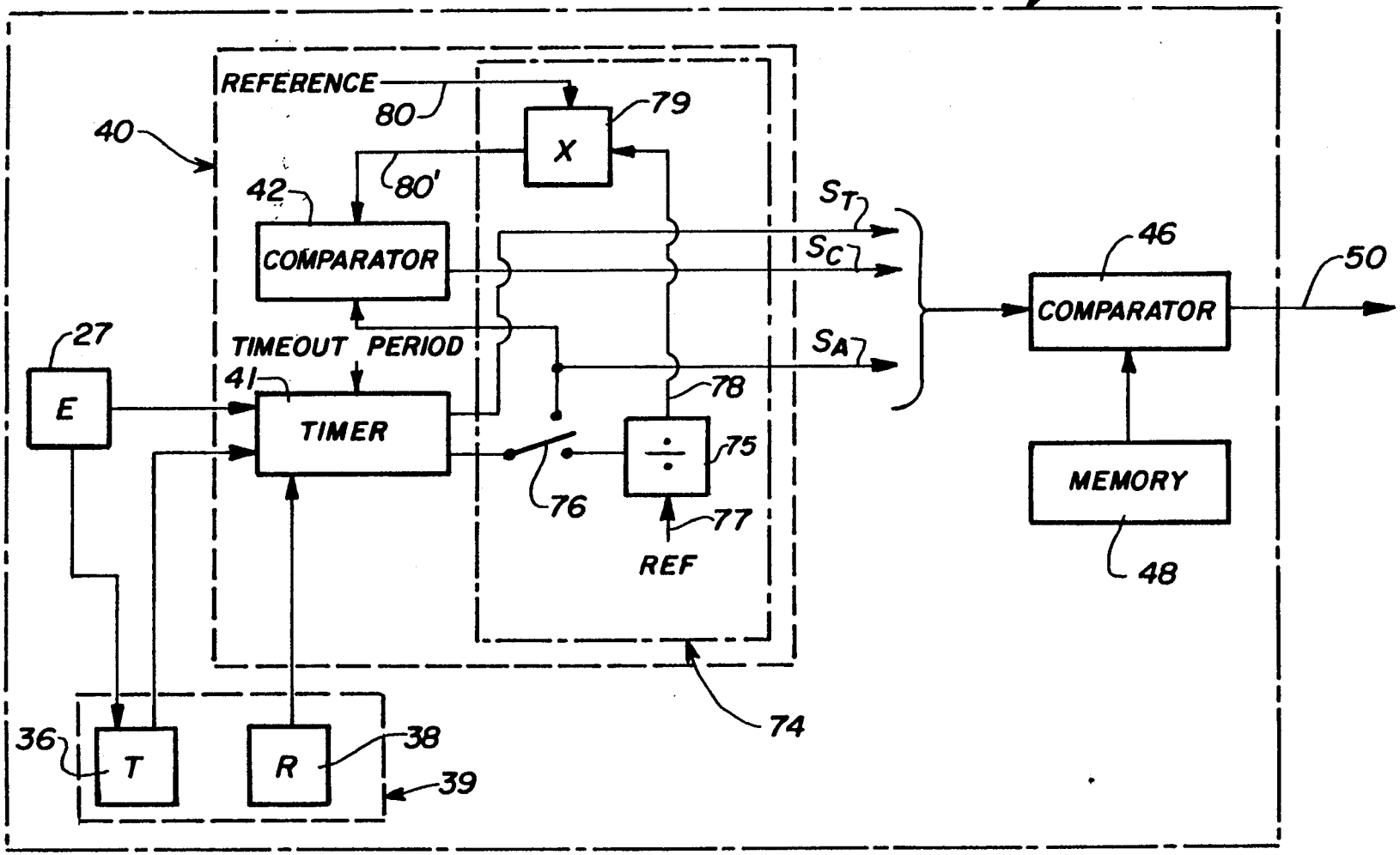

In both FIGS. 7A and 7B the means 74 includes a network 75 for generating a temperature compensation factor. The network 75 is connected to the timer 41 via a switch 76. When the switch 76 is asserted to connect the timer 41 to the network 75 a signature signal output from the timer 41 representative of the measured distance from the transducer to a predetermined target surface on the chamber 16 and back is applied to the network 75. The network 75 relates the signature signal from the timer 41 to a reference signal on a line 77 representative of the actual distance from the transducer to the target surface and back.

In the embodiment of FIG. 7A the temperature compensation factor is produced by dividing the reference distance signal by the measured distance signal. Alternatively in the embodiment of FIG. 7B the temperature compensation factor is produced by dividing the measured distance signal by the reference distance signal. In either case the temperature compensation factor is output on a line 78.

The compensation factor may be used in several ways. As shown in FIG. 7A the means 74 also includes a network 79. With the switch 76 asserted to connect the timer 41 to the network 79 the network 79 is operable to multiply the signature signals of the type $S_A$ output from the timer 41 by the temperature compensation factor on the line 78. This action results in the creation of modified signature signals of the $S_A$ type. The modified signals may be applied directly to the comparator 46 or may be applied to the comparator 42 to generate modified signature signals of the $S_C$ type, by comparison with the reference value on the line 80, as described earlier.

Alternatively as shown in FIG. 7B the temperature compensation factor on the line 78 may be used to modify the reference time period on the line 80 used by the comparator 42. To this end the network 79 multiplies the reference time period on the line 80 by the compensation factor (as produced by the network of FIG. 7B). With the switch 76 asserted to connect the timer 41 to the comparator 42 the modified reference time period on line 80 output from the network 79 is used by the comparator 42 to create modified signature signals of the $S_C$ type. Although not illustrated in the Figures it should be understood that in an analogous manner the time-out period of the timer 41 could alternatively be modified. This action would result in the production of appropriately modified signature signals of the $S_T$ type.

In a refrigerated centrifuge as shown in FIG. 1 where a refrigerant is flowed through the coils 22C on the walls 16S and the floor 16F but not present on the door 24 of the instrument, in a nonevacuated environment slow moving convective air currents of differing temperatures are created. As previously mentioned the speed of sound is influenced by the temperature of the medium. In order to obtain uniform temperature compensation throughout the chamber 16 these air currents should be eliminated. The insert 26I of the door seal assembly 26 is fabricated of a thermally insulating material to minimize the effect of the door 24 as a heat source. Additionally, it has been found that by raising the temperature of the wall 16S of the chamber 16 to a temperature nearer to that of the door 24 the temperature differences are eliminated. Heating the wall 16S has the added advantage of reducing condensation and frosting of the chamber 16. The wall 16S may be heated prior to an interrogation of the chamber by circulating an elevated temperature fluid through the coils 22C.

Figure 9:
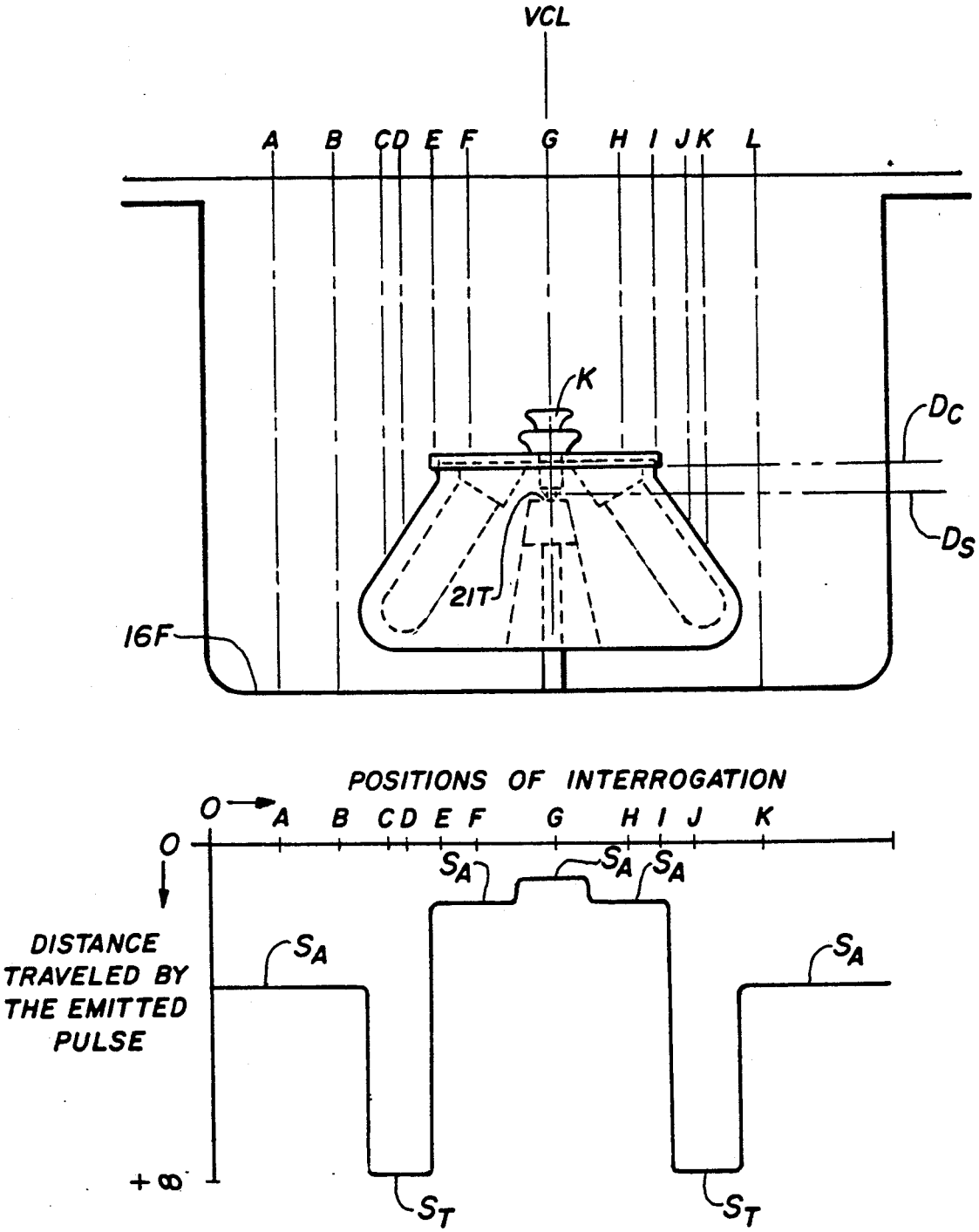
FIG. 9 is a stYlized side elevational view of a rotor mounted in a chamber depicting the location of rotor interrogation positions in the chamber and the associated output of the transducer in accordance with the preferred embodiment of the present invention.
Figure 10:
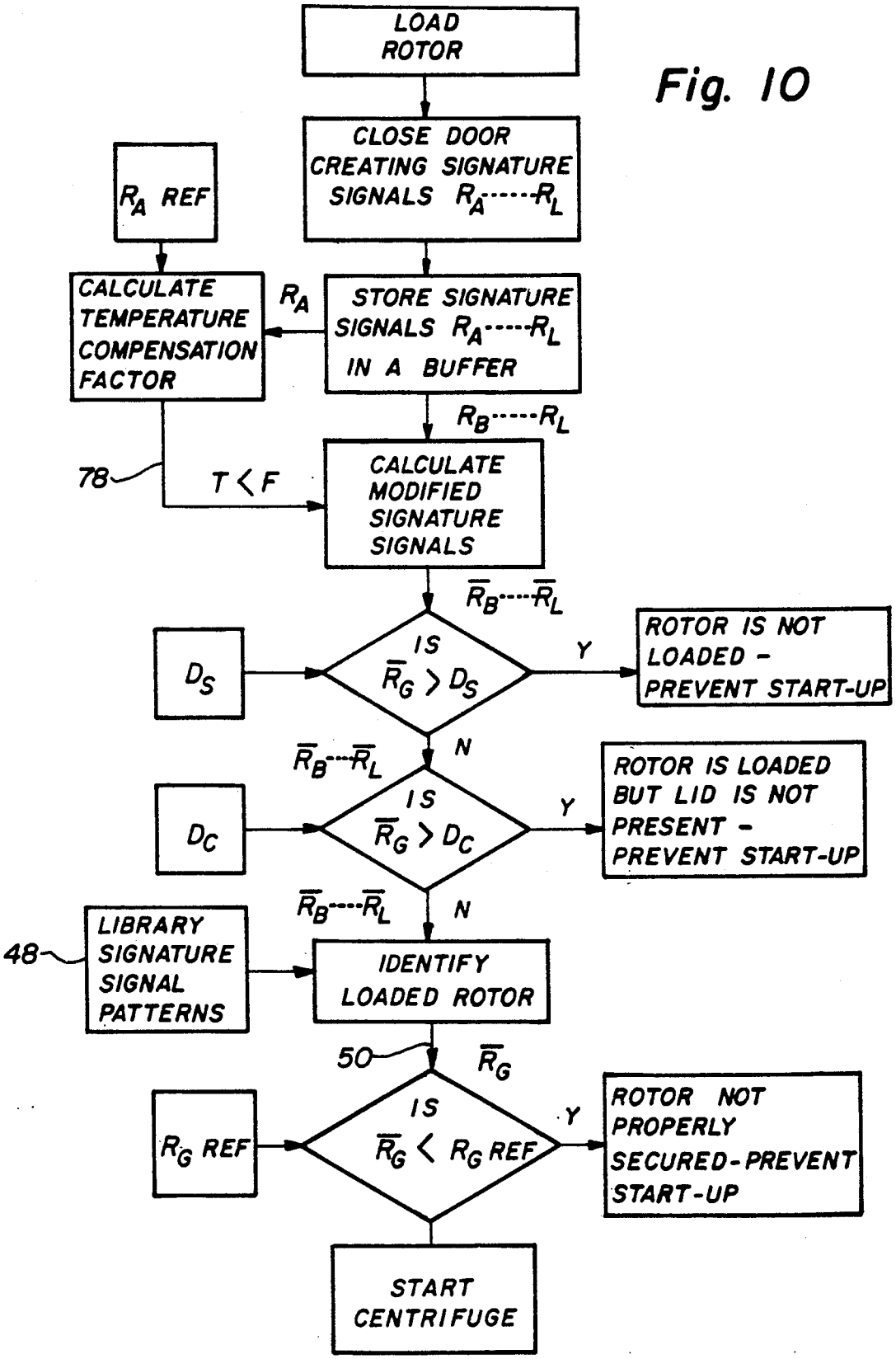
FIG. 10 is a flow diagram of a program useful to implement the rotor recognition system to interrogate a rotor at the interrogation positions shown in FIG. 9 in accordance with the preferred embodiment of the present invention.

The detailed operation of the recognition system may now be understood from the following explanation taken in conjunction with FIGS. 9 and 10, which are, respectively, a diagrammatic view of the chamber illustrating the locations of the preferred predetermined positions of interrogation with the outline of a rotor (an SS-34 rotor as identified above) and a flow diagram of the sequence of steps used in the interrogation and subsequent recognition of an unknown rotor in accordance with the preferred embodiment of present invention.

During the closure of the door 24 the transducer 39 is moved radially across the chamber and interrogations of the chamber and the rotor are caused to occur at each of twelve lettered radial positions. The radial position of the transducer 39 with respect to the axis of rotation VCL as the door is closed is determined by the encoder assembly 27. The output of the encoder assembly 27 is used to initiate the interrogations at the appropriate radial distance. The positions B through F are arranged at symmetrical radial distances from the axis VCL with respect to respective counterpart positions H through L. The position G is located on the axis VCL over the surface 21T of the spud 21. The position A is a temperature compensation position which is located at any convenient radial distance away from the rotor R but still within the chamber. It should be understood of course, that the number and exact location within the chamber of any of the interrogation positions shown (including the position A) may vary.

In operation, a rotor R to be processed is placed into the chamber 16 onto the spud 21. The door 24 is closed, causing the transducer 39 to be moved across the chamber 16 and thus, across the rotor mounted therein. During this closing movement interrogation of the chamber (at the position A) and interrogations of the rotor (at the positions B through L) are conducted and signature signals are developed. The signature signals produced are either of the $S_A$ or $S_T$ type as shown in FIG. 9. It is noted that the inflection points of the curve in FIG. 9 do not coincide exactly to the contour of the rotor due to beam width 61 (FIG. 5) but closely approximate the same. The signature signals produced are stored in a suitable buffer for later processing.

The speed at which the door 24 is closed by an operator should be limited so that secondary echoes from the surface interrogated at any position of interrogation will have time to dissipate before a subsequent interrogation at a different interrogation position occurs. If this consideration as to dissipation of secondary echoes is coupled with the recognition of the maximum probably door closing speed able to be attained by an operator (assumed to be on the order of forty inches per second) then spacings between interrogation positions of 0.2 inches (0.508 cm.) are more than adequate to satisfy the requirement that secondary echoes be dissipated before a subsequent reading is taken. If necessary, a dashpot or the like may be used to limit the closing speed of the door.

The temperature compensation factor is calculated using the signature signal derived from the interrogation of the floor of the chamber at position A as discussed in connection with FIGS. 7A or 7B. If the temperature compensation factor is calculated in the manner discussed in FIG. 7A the temperature compensation factor is applied to the other signature signals as derived from positions of interrogation B through L thereby to produce modified signature signals from these positions. If the temperature compensation factor is calculated in the manner discussed in FIG. 7B the reference for the comparator or the time out period is modified. In the discussion of FIGS. 9 and 10 that follows it is assumed that compensation factor is calculated as discussed in FIG. 7A.

Next, the modified signature signal derived from the position G (the position on the axis VCL) is compared to the reference distance to and from a reference datum plane $D_S$ which is located at a height from the floor just above the surface 21T from the spud. If the distance represented by the modified signature signal is greater than the reference distance (to and from the plane $D_S$) then the surface 21T has caused the reflection and thus it is known that a rotor is not present on the spud 21. If the distance represented by the signature signal is less than this first reference distance then the distance represented by the signature signal is compared to a second reference distance. representative of the distance to and from a second datum plane $D_C$. If the distance represented by the signature signal is less than the first reference distance and greater than the second reference distance then a rotor is known to be installed on the spud, but the cover C of the rotor is not present. If a rotor is not present or if a cover is not on the rotor, the centrifuge instrument may be disabled from operation. If the distance represented by the signature signal is less than the first and the second reference distances the recognition program is allowed to continue.

To identify the rotor the modified signature signals are each compared by the comparator (to create modified signature signals of the $S_C$ type). It is noted that since all rotors used in the instrument are symmetric and since, in the preferred case the interrogation positions are symmetric with respect to the axis VCL, in effect two readings of the unknown rotor are taken, one at each side of the axis. This serves as a check on each reading. A truth table is then created in a manner similar to that discussed in connection with FIG. 4 with the reference datum plane $D_S$ used as the basis of comparison.

The final signature signal pattern as set forth in the table resulting from these operations is compared with the library to produce the indicator signal indicative of the identity of the rotor.

Once the rotor identity is known a reference valve equal to the distance from the transducer to the top surface of the knob K of the particular rotor and back that has been identified is obtained from memory. The modified signature signal at the interrogation position G is then compared to this reference distance. If the distance represented by the modified signature signal is less than this reference distance then it is understood that the rotor is not properly secured to the spud. The instrument is disabled from starting in this event. If the distance represented by the modified signature signal is greater than or equal to this reference distance the rotor is properly installed and the operation of the instrument is permitted to commence.

An alternate embodiment would provide pairs of transmitters and associated receivers (whether or not integrated as a single transducer) at any number of predetermined fixed locations within the instrument 10, e.g., on the underside wall of the door 24. One such pair of these additional transmitters/receivers is provided in a housing indicated by the character 50' FIG. 1). Each transmitter/receiver pair is arranged to interrogate the rotor at a predetermined radial position to generate a signature signal from each pair. Such an arrangement using plural transducers may be particularly suitable for use with a door of the hinged type.

It also lies within the contemplation of the present invention to mount a single transmitter 36 at a predetermined position within the instrument on a bracket 52 (FIG. 1) provided with an articulable joint 54 whereby the angle of interrogation from the transmitter may be varied such that different locations on the surface of the rotor may be interrogated. A corresponding receiver 38 may be provided on a suitable similar bracket 52 with a joint 54 articulable to cause the receiver 38 to follow the transmitter. Alternatively, plural receivers 38 may be fixed to the centrifuge instrument to respond to energy emitted from the transmitter 36 at each angle of interrogation. Yet further, plural fixed transmitters 36 with an articulably mounted receiver may be used and remain within the contemplation of this invention.

It should be understood that the number of transmitters and/or receivers, their mode of operation, their frequencies of operation, the duration of their respective operation and any other pertinent operational parameters may be conveniently selected and remain within the contemplation of the present invention.

The functional elements of the present invention as herein set forth, including the 40, 41, 42, 46 and 48, may be configured in any suitable fashion. These elements are preferably electronic devices arranged to provide the functions discussed. They may be implemented in any suitable form, including a microprocessor based system operating in accordance with a program.

It should also be understood that although the invention has been described in terms of interrogation of the upper surface of the rotor, other surfaces thereof may be interrogated and remain within the contemplation of the present invention.

To enhance the certainty of the rotor recognition correspondence between a detected signature signal or signature signal pattern and a reference signature signal or signal pattern stored in the library may be required to occur to within a predetermined range of error on some predetermined subset of the number of interrogated points. For example, if a rotor is interrogated at each of eight radial positions within the chamber the response time of a returning signal may be required to fall within some predetermined percentage (typically 2.5%) of the expected response time at no less than five of the eight interrogated points before the system will produce an indicator signal representative of its conclusion as to the identity of the unknown rotor.

The recognition system is sufficientlY sensitive to provide further useful information regarding the particular rotor mounted within the centrifuge chamber or bowl. For example, the signature signal or signature pattern produced by interrogation of a rotor may indicate that the cover C of that rotor is not in place, has not been securely fastened thereto or, alternatively, that the rotor is not securely mounted atop the drive spindle 18.

Those skilled in the art having benefit of the teachings of the present invention as hereinabove set forth may effect numerous modifications thereto. It should be understood, that these modifications are to be construed as lying within the scope of the present invention as the same is defined by the appended claims.

I claim:

1. In a centrifuge having a chamber with mounting means within the chamber for receiving any one of a plurality of rotor elements, the improvement which comprises:

a transmitter and a receiver, the transmitter being operative to emit a pulse of interrogating energy impingeable on a surface of a rotor disposed on the mounting means, the receiver being cooperatively associated with the transmitter and responsive to the pulse of interrogating energy to generate a signature signal representative of the distance traveled by the pulse of interrogating energy.

2. The centrifuge of claim 1 wherein the improvement further comprises:

means responsive to the signature signal for generating an indicator signal having information therein representative of the identify of the particular rotor present in the centrifuge.

3. The centrifuge of claim 2 wherein the transmitter is adapted to generate sonic energy.

4. The centrifuge of claim 3 wherein the means responsive to the signature signal itself comprises:

a library having stored therein a predetermined plurality of signature signals each representative of a particular centrifuge rotor; and a comparator for comparing the signature signal with the stored signature signals and for generating the indicator signal.

5. The centrifuge of claim 2 wherein the transmitter is adapted to generate electromagnetic energy.

6. The centrifuge of claim 5 wherein the means responsive to the signature signal itself comprises:

a library having stored therein a predetermined plurality of signature signals each representative of a particular centrifuge rotor; and a comparator for comparing the signature signal with the stored signature signals and for generating the indicator signal.

7. The centrifuge of claim 2 wherein the means responsive to the signature signal itself comprises:

a library having stored therein a predetermined plurality of signature signals each representative of a particular centrifuge rotor; and a comparator for comparing the signature signal with the stored signature signals and for generating the indicator signal.

8. The centrifuge of claim 1 wherein the transmitter is adapted to generate sonic energy.

9. The centrifuge of claim 1 wherein the transmitter is adapted to generate electromagnetic energy.

10. The centrifuge of claim 1 wherein the transmitter and receiver are adapted to generate a second signature signal representative of the distance between the receiver and a second point on the surface of the rotor, the first and second signature signals cooperating to define a signature signal pattern.

11. The centrifuge of claim 10 wherein the improvement further comprises: means responsive to the signature signal pattern for generating an indicator signal having information therein representative of the identity of the particular rotor present in the centrifuge.

12. The centrifuge of claim 11 wherein the transmitter is adapted to generate sonic energy.

13. The centrifuge of claim 12 wherein the means responsive to the signature signal itself comprises a library having stored therein a predetermined pluralitY of signature signals patterns each representative of a particular centrifuge rotor; and a comparator for comparing the signature signal with the stored signature signal patterns and for generating the indicator signal.

14. The centrifuge of claim 11 wherein the transmitter is adapted to generate electromagnetic energy.

15. The centrifuge of claim 14 wherein the means responsive to the signature signal itself comprises:

a library having stored therein a predetermined plurality of signature signals patterns each representative of a particular centrifuge rotor; and a comparator for comparing the signature signal with the stored signature signal patterns and for generating the indicator signal.

16. The centrifuge of claim 11 wherein the means responsive to the signature signal itself comprises:

a library having stored therein a predetermined plurality of signature signals patterns each representative of a particular centrifuge rotor; and a comparator for comparing the signature signal with the stored signature signal patterns and for generating the indicator signal.

17. The centrifuge of claim 1 wherein the improvement further comprises:

a second receiver cooperating with the transmitter for generating a second signature signal representative of the distance between the second receiver and at least a second point on the surface of the rotor, the first and second signature signals cooperating to form a signature pattern.

18. The centrifuge of claim 17 wherein the improvement further comprises:

means responsive to the signature signal pattern for generating an indicator signal having information therein representative of the identity of the particular rotor present in the centrifuge.

19. The centrifuge of claim 18 wherein the transmitter is adapted to generate sonic energy.

20. The centrifuge of claim 19 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

21. The centrifuge of claim 18 wherein the transmitter is adapted to generate electromagnetic energy.

22. The centrifuge of claim 21 wherein the means responsive to the signature signal itself comprises:

a librarY having stored therein a predetermined plurality of signature signal patterns each representative of a particular centrifuge rotor; and a comparator for comparing the signature signal pattern with the stored signature signal patterns and for generating the indicator signal.

23. The centrifuge of claim 18 wherein the means responsive to the signature signal itself comprises:

a library having stored therein a predetermined pluralitY of signature signal patterns each representative of a particular centrifuge rotor: and a comparator for comparing the signature signal pattern with the stored signature signal patterns and for generating the indicator signal.

24. The centrifuge of claim 1 wherein the improvement further comprises:

a second transmitter and a second receiver cooperating to generate a second signature signal representative of the distance between the second receiver and at least a second point on the surface of the rotor, the first and second signature signals cooperating to form a signature pattern.

25. The centrifuge of claim 24 wherein the improvement further comprises:

means responsive to the signature signal pattern for generating an indicator signal having information therein representative of the identity of the particular rotor present in the centrifuge.

26. The centrifuge of claim 25 wherein the transmitter is adapted to generate sonic energy.

27. The centrifuge of claim 26 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

28. The centrifuge of claim 25 wherein the transmitter is adapted to generate electromagnetic energy.

29. The centrifuge of claim 28 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

30. The centrifuge of claim 25 wherein the means responsible to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

31. The centrifuge of claim 1 wherein the improvement further comprises:

means for conveying the transmitter and the receiver along a predetermined path across the surface of the rotor for generating a signature signal from each of a plurality of points on the surface of the rotor, the plural signature signals collectively defining a signature signal pattern.

32. The centrifuge of claim 31 wherein the improvement further comprises:

means responsive to the signature signal pattern for generating an indicator signal having information therein representative of the identitY of the particular rotor present in the centrifuge.

33. The centrifuge of claim 32 wherein the transmitter is adapted to generate sonic energy.

34. The centrifuge of claim 33 wherein the means responsive to the signature signal itself comprises:

a library having stored therein a predetermined plurality of signature signal pattern each representative of a particular centrifuge rotor, and a comparator for comparing the signature signal pattern with the stored signature signal patterns and for generating the indicator signal.

35. The centrifuge of claim 32 wherein the transmitter is adapted to generate electromagnetic energy.

36. The centrifuge of claim 35 wherein the means responsive to the signature signal itself comprises:

a library having stored therein a predetermined pluralitY of signature signal patterns each representative of a particular centrifuge rotor; and a comparator for comparing the signature signal pattern with the stored signature signal patterns and for generating the indicator signal.

37. The centrifuge of claim 32 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

38. The centrifuge of claim 1 wherein the pulse of interrogation energy is directed toward at least one point on the surface of a rotor element on the mounting means and the reflection therefrom is detectable by the receiver such that the signature signal contains information as to the distance between the surface of the rotor and the receiver.

39. The centrifuge of claim 38 further comprising a comparator operative to compare the signature signal with a signal representative of a predetermined reference distance.

40. The centrifuge of claim 39 wherein the reference distance represents the total distance from the transmitter to a predetermined reference plane and from the predetermined reference plane to the receiver.

41. The centrifuge of claim 39 wherein the reference distance represents the total distance from the transmitter to a predetermined target surface in the chamber and from the predetermined target surface to the receiver.

42. The centrifuge of claim 1 wherein the pulse of interrogating energy is directed toward at least one point on the surface of a rotor element mounted on the mounting means and the reflection therefrom is not detectable by the receiver within a predetermined period of time following the emission thereof from the transmitter such that the signature signal contains information that the distance traveled by the pulse of interrogating energy is greater than a predetermined reference distance.

43. The centrifuge of claim 42 wherein the reference distance represents the total distance from the transmitter to a predetermined target surface in the chamber and from the predetermined target surface to the receiver.

44. The centrifuge of claim 42 further comprising a comparator operative to compare the signature signal representative of a second predetermined reference distance.

45. The centrifuge of claim 1 wherein the chamber has a predetermined target surface thereon, and wherein a predetermined known total reference distance is defined by the sum of the distance from the transmitter to the target surface and from the target surface to the receiver, and wherein the transmitter emits a first pulse of energy toward the target surface such that the reflection therefrom is detectable by the receiver to generate a first signature signal.

wherein the improvement further comprises:

means for relating the first signature signal to a signal representative of the predetermined known total reference distance for generating a compensation factor that takes into account deviations in the first signature signal caused by the ambient environment in the chamber.

46. The centrifuge of claim 45 wherein the transmitter emits a second pulse of energy toward a point on the surface of a rotor element received on the mounting means such that the reflection therefrom is detectable by the receiver to generate a second signature signal. wherein the improvement further comprises means for scaling the second signature signal by the compensation factor thereby to generate a compensated second modified signature signal.

47. The centrifuge of claim 45 wherein the transmitter emits a second and a third pulse of energy toward respective points on the surface of a rotor element received on the mounting means such that the reflection of the second and third pulses therefrom are detectable by the receiver to generate a second and a third signature signal, the second and third signature signals cooperate to define a signature signal pattern wherein the improvement further comprises:

means for scaling each of the second and third signature signals by the compensation factor thereby to generate second and third compensated signature signals which cooperate to define a compensated signature signal pattern.

48. The centrifuge of claim 1 wherein the pulse of interrogating energy is directed toward the mounting means and the reflection therefrom is detectable by the receiver such that the signature signal contains information relative to the presence of a rotor element on the mounting means.

49. The centrifuge of claim 1 wherein the pulse of interrogating energy is directed toward the rotor element, the improvement further comprising means responsive to the signature signal for comparing the signature signal to a signal representative of a reference distance, the results of the comparison being indicative of the presence of a rotor element on the mounting means.

50. The centrifuge of claim 1 wherein the rotor element includes a lid and wherein the pulse of interrogating energy is directed toward the rotor element, the improvement further comprising means responsive to the signature signal for comparing the signature signal to a signal representative of a reference distance, the results of the comparison being indicative of the presence of the lid on the rotor element.

51. The centrifuge of claim 1 wherein the transmitter and the receiver are configured from a single device which alternately functions as the transmitter and as the receiver.

52. In a centrifuge adapted to receive any one of a plurality of rotor elements each of which has a surface thereon, the improvement which comprises:

a transmitter and a receiver, the transmitter being operative to emit a pulse of interrogating energy directed toward at least one point on the surface of a rotor received within the centrifuge, the receiver being responsive to the pulse of interrogating energy reflected from the surface of the rotor, the transmitter and the receiver cooperating to generate a signature signal representative of the distance between the receiver and the one point on the surface of the rotor.

53. The centrifuge of claim 52 wherein the improvement further comprises:

means responsive to the signature signal for generating an indicator signal having information therein representative of the identity of the particular rotor present in the centrifuge.

54. The centrifuge of claim 53 wherein the transmitter is adapted to generate sonic energy.

55. The centrifuge of claim 54 wherein the means responsive to the signature signal itself comprises:

a library having stored therein a predetermined plurality of signature signals each representative of a particular centrifuge rotor; and a comparator for comparing the signature signal with the stored signature signals and for generating the indicator signal.

56. The centrifuge of claim 53 wherein the transmitter is adapted to generate electromagnetic energy.

57. The centrifuge of claim 53 wherein the means responsive to the signature signal itself comprises:

a library having stored therein a predetermined plurality of signature signals each representative of a particular centrifuge rotor; and a comparator for comparing the signature signal with the stored signature signals and for generating the indicator signal.

58. The centrifuge of claim 57 wherein the means responsive to the signature signal itself comprises:

a library having stored therein a predetermined plurality of signature signals each representative of a particular centrifuge rotor; and a comparator for comparing the signature signal with the stored signature signals and for generating the indicator signal.

59. The centrifuge of claim 52 wherein the transmitter is adapted to generate sonic energy.

60. The centrifuge of claim 52 wherein the transmitter is adapted to generate electromagnetic energy.

61. The centrifuge of claim 52 wherein the transmitter and receiver are adapted to generate a second signature signal representative of the distance between the receiver and a second point on the surface of the rotor, the first and second signature signals cooperating to define a signature signal pattern.

62. The centrifuge of claim 61 wherein the improvement further comprises:

means responsive to the signature signal pattern for generating an indicator signal having information therein representative of the identity of the particular rotor present in the centrifuge.

63. The centrifuge of claim 62 wherein the transmitter is adapted to generate sonic energy.

64. The centrifuge of claim 63 wherein the means responsive to the signature signal itself comprises:

a library having stored therein a predetermined plurality of signature signals patterns each representative of a particular centrifuge rotor; and a comparator for comparing the signature signal with the stored signature signal patterns and for generating the indicator signal.

65. The centrifuge of claim 62 wherein the transmitter is adapted to generate electromagnetic energy.

66. The centrifuge of claim 65 wherein the means responsive to the signature signal itself comprises:

a library having stored therein a predetermined plurality of signature signals patterns each representative of a particular centrifuge rotor; and a comparator for comparing the signature signal with the stored signature signal patterns and for generating the indicator signal.

67. The centrifuge of claim 62 wherein the means responsive to the signature signal itself comprises:

a library having stored therein a predetermined plurality of signature signals patterns each representative of a particular centrifuge rotor; and a comparator for comparing the signature signal with the stored signature signal patterns and for generating the indicator signal.

68. The centrifuge of claim 52 wherein the improvement further comprises:

a second receiver cooperating with the transmitter for generating a second signature signal representative of the distance between the second receiver and at least a second point on the surface of the rotor, the first and second signature signals cooperating to form a signature pattern.

69. The centrifuge of claim 68 wherein the improvement further comprises:

means responsive to the signature signal pattern for generating an indicator signal having information therein representative of the identity of the particular rotor present in the centrifuge.

70. The centrifuge of claim 69 wherein the transmitter is adapted to generate sonic energy.

71. The centrifuge of claim 70 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

72. The centrifuge of claim 69 wherein the transmitter is adapted to generate electromagnetic energy.

73. The centrifuge of claim 72 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

74. The centrifuge of claim 69 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

75. The centrifuge of claim 52 wherein the improvement further comprises:

a second transmitter and a second receiver cooperating to generate a second signature signal representative of the distance between the second receiver and at least a second point on the surface of the rotor, the first and second signature signals cooperating to form a signature pattern.

76. The centrifuge of claim 75 wherein the improvement further comprises:

means responsive to the signature signal pattern for generating an indicator signal having information therein representative of the identify of the particular rotor present in the centrifuge.

77. The centrifuge of claim 76 wherein the transmitter is adapted to generate sonic energy.

78. The centrifuge of claim 77 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

79. The centrifuge of claim 76 wherein the transmitter is adapted to generate electromagnetic energy.

80. The centrifuge of claim 79 wherein the means responsive to the signature signal itself comprises:

a librarY having stored therein a predetermined plurality of signature signal patterns each representative of a particular centrifuge rotor; and a comparator for comparing the signature signal pattern with the stored signature signal patterns and for generating the indicator signal.

81. The centrifuge of claim 76 wherein the means responsible to the signature signal itself comprises:

a library having stored therein a predetermined plurality of signature signal patterns such representative of a particular centrifuge rotor; and a comparator for comparing the signature signal pattern with the stored signature signal patterns and for generating the indicator signal.

82. The centrifuge of claim 52 wherein the improvement further comprises:

means for conveying the transmitter and the receiver along a predetermined path across the surface of the rotor for generating a signature signal from each of a plurality of points on the surface of the rotor, the plural signature signals collectively defining a signature signal pattern.

83. The centrifuge of claim 82 wherein the improvement further comprises:

means responsive to the signature signal pattern for generating an indicator signal having information therein representative of the identity of the particular rotor present in the centrifuge.

84. The centrifuge of claim 83 wherein the transmitter is adapted to generate sonic energy.

85. The centrifuge of claim 84 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

86. The centrifuge of claim 83 wherein the transmitter is adapted to generate electromagnetic energy.

87. The centrifuge of claim 86 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

88. The centrifuge of claim 83 wherein the means responsive to the signature signal itself comprises:

a library having stored therein a predetermined plurality of signature signal patterns each representative of a particular centrifuge rotor; and a comparator for comparing the signature signal pattern with the stored signature signal patterns and for generating the indicator signal.

* * * * *